US005538082A

United States Patent [19]

Zwart

[11] Patent Number: 5,538,082

[45] Date of Patent: Jul. 23, 1996

[54] DOWNHOLE RUNNING SYSTEM & METHOD FOR SETTING A DOWNHOLE TOOL IN A BORE

[76] Inventor: Klaas J. Zwart, Drumgarth, Inchagarth Road, Cults, Aberdeen AB1 9NX, United Kingdom

[21] Appl. No.: 392,066

[22] Filed: Feb. 22, 1995

[30] Foreign Application Priority Data

Feb. 22, 1994 [GB] United Kingdom ..... 9403312

[51] Int. Cl.[6] ..... E21B 23/02

[52] U.S. Cl. ..... 166/382; 166/215; 166/123

[58] Field of Search ..... 166/382, 215, 166/217, 125, 123, 373, 136, 212, 237, 72

[56] References Cited

U.S. PATENT DOCUMENTS

| | | | |
|---|---|---|---|
| 3,638,723 | 2/1972 | Carroll | 166/215 |
| 4,437,522 | 3/1984 | Krause, Jr. et al. . | |
| 4,488,596 | 12/1984 | Akkerman | 166/217 |
| 4,830,107 | 5/1989 | Rumbaugh | 166/373 X |
| 5,226,483 | 7/1993 | Williamson, Jr. | 166/375 |
| 5,314,026 | 5/1994 | Williamson, Jr. | 166/386 |
| 5,366,010 | 11/1994 | Zwart | 166/123 X |

FOREIGN PATENT DOCUMENTS 1587045 3/1981 United Kingdom .

2244739 6/1990 United Kingdom .

OTHER PUBLICATIONS

Baker Packers—Sur-Set Flow Control—Baker Models "A-1" 801-87, H-1 801-88; dated Feb. 25, 1986; pp. 1-6.

Baker Packers—Flow Control Systems—Selective "Sur--Set" Wireline Lock Assembly; p. 619.

Camco13 Series "M" Lock—Section D—Series DB Landing Nipples And Locks; p. 1399.

Camco—Type R, GA and W Series Running Tools—Section E; p. 1413.

Otis—Subsurface Flow Control Completion Equipment—Introduction To Otis Subsurface Flow Control Completion Equipment; pp. 115-116.

*Primary Examiner*—Frank Tsay

*Attorney, Agent, or Firm*—Bell, Seltzer, Park & Gibson

[57] ABSTRACT

A downhole running system for use in setting a downhole tool in a bore includes a running tool comprising: radially extending members for holding the tool at a desired location in a bore and being selectively configurable, in a first configuration, to permit running the tool in through a restriction in a bore and, in a second configuration, to prevent passage of the tool through a restriction and to engage the wall of a bore to permit manipulation of the tool against a fixed point in the bore; an arrangement for releasably mounting a downhole tool on the running tool; and an arrangement for setting the downhole tool.

16 Claims, 3 Drawing Sheets

DOWNHOLE RUNNING SYSTEM & METHOD FOR SETTING A DOWNHOLE TOOL IN A BORE

FIELD OF THE INVENTION

This invention relates to a downhole running system for use in setting a downhole tool, such as a lock mandrel, in a bore. The invention also relates to a method of utilizing a running tool to set a second tool in a bore.

BACKGROUND 0F THE INVENTION

In the oil and gas exploration and extraction industries it is often desired to lock or set tools within a bore to allow, for example, the bore to be sealed or to provide a mounting or carrier for other tools to be located within the bore. Conventionally, such tools are located in the bore by means of keys or dogs which are expanded to engage with an annular recess in a restriction in the bore, known as a locating nipple. In order to permit manipulation of the tool to expand the keys a shoulder, known as a no-go, is provided adjacent the recess or nipple profile and provides a stop for the tool and a point against which force which can be applied for manipulation and setting of the tool. Such no-gos provide a relatively straightforward and simple means for location of such tools, it merely being necessary to provide the tool with, for example, a collar sized to engage a particular no-go as the tool is run into a bore on the end of a tool string. However, each no-go reduces the diameter of the bore and thus the provision of a number of no-gos in a bore significantly reduces the minimum internal diameter of the bore. This can be detrimental to the wellbore for various reasons, not least that the flow area of the bore which oil or gas can be produced through is reduced.

In recognition of this problem there have been various proposals for "selective" locks, which may be located and set in a bore without requiring the provision of no-gos in the bore. However, in order to permit locking keys to be set, these locks are provided with arrangements for engaging the bore wall prior to the keys being set. This has resulted in relatively complex systems and the additional point of engagement between the lock and the bore wall can lead to difficulties when attempting to remove such locks. Locks of this form currently available include the SUR-SET selective lock supplied by Baker Packers, the Otis X and Otis R lock mandrels, and the Camco Series DB landing locks.

It is among the objects of the present invention to obviate or mitigate these disadvantages.

SUMMARY OF THE INVENTION

According to the present invention there is provided a downhole running system for use in setting a downhole tool in a bore, the system including a running tool comprising:

holding means selectively configurable, in a first configuration, to permit running the tool in through a restriction in a bore and, in a second configuration, to prevent passage of the tool through a restriction and to engage the wall of a bore to permit manipulation of the tool against a fixed point in the bore;

means for releasably mounting a downhole tool on the running tool; and means for setting the downhole tool.

According to a further aspect of the present invention there is provided a method of utilising a running tool to set a downhole tool in a bore, the method comprising:

mounting the downhole tool on the running tool;

running the tools into a bore on a string with the running tool configured to permit the tools to pass through restrictions in the bore;

configuring holding means on the running tool to engage a wall of the bore and to prevent passage of the tool through a selected restriction;

manipulating the string, against said holding means, to set the downhole tool;

manipulating the string to release the running tool from the downhole tool; and pulling the running tool out of the bore.

In use, the invention allows tools to be run through a number of restrictions to a selected location in the bore. The running tool may then be manipulated to configure the holding means to engage, for example, a shoulder or landing nipple above the restriction at that location. The operator may then manipulate the string against the holding means to set the downhole tool. Thus, the invention allows tools to be set in a bore without requiring the provision of "no-gos", which restrict the bore diameter. In addition, the holding means is provided on the running tool and is therefore removed from the bore after the downhole tool is set. This minimizes the volume and complexity of hardware left in the bore and hence there is less likelihood of the downhole tool not releasing correctly when it is desired to remove the tool from the bore.

Preferably, the holding means is initially biased to assume the first configuration in which the means will engage restrictions in the bore, but is movable to permit downwards passage of the running tool through a restriction on engagement with the restriction. This provides the operator with a positive indication that the tool has passed through a restriction, as the initial contact between the restriction and the holding means will be detectable at the surface.

Preferably also, the holding means is moveable from the first configuration to the second configuration in which the means is biased to engage restrictions in the bore but is movable to permit upwards passage of the running tool through a restriction on engagement with the restriction. Thus, the tool may be pulled up through a restriction and then positively located above the restriction to permit manipulation of the string to set the downhole tool.

Preferably also, the holding means is moveable from said first configuration to said second configuration by manipulation of the string. Most preferably, the holding means is moveable by jarring the running tool to operate release means in the form of a shear pin or the like. The tool may be jarred against a downwardly directed shoulder provided below or on a lower portion of the restriction.

Preferably also, the running tool further comprises second holding means for releasably engaging restrictions in the bore. Most preferably, the second holding means is located above the first holding means such that the second holding means may retain the tools in the bore on the return stroke of the jar utilised to move the holding means between the first and second configurations.

Preferably also, the running tool is provided in combination with a downhole tool. Most preferably, the downhole tool is self-setting, such that the setting means on the running tool is actuateable to permit self-setting of the second tool. Thus, actuation of the setting means may, for example, permit relative movement of parts of the downhole tool to extend engagement means, such as keys, to engage with recesses in the bore wall. The basis for such a downhole tool, in the form of a lock mandrel, is described in U.S. Pat.

No. 4,883,121 : use of the disclosed lock mandrel in the present invention would require the removal of the no-go shoulder provided on the mandrel.

BRIEF DESCRIPTION OF THE DRAWINGS

These and other aspects of the present invention will now be described, by way of example, with reference to the accompanying drawings, in which.

DETAILED DESCRIPTION OF PREFERRED EMBODIMENTS

Figure 1:
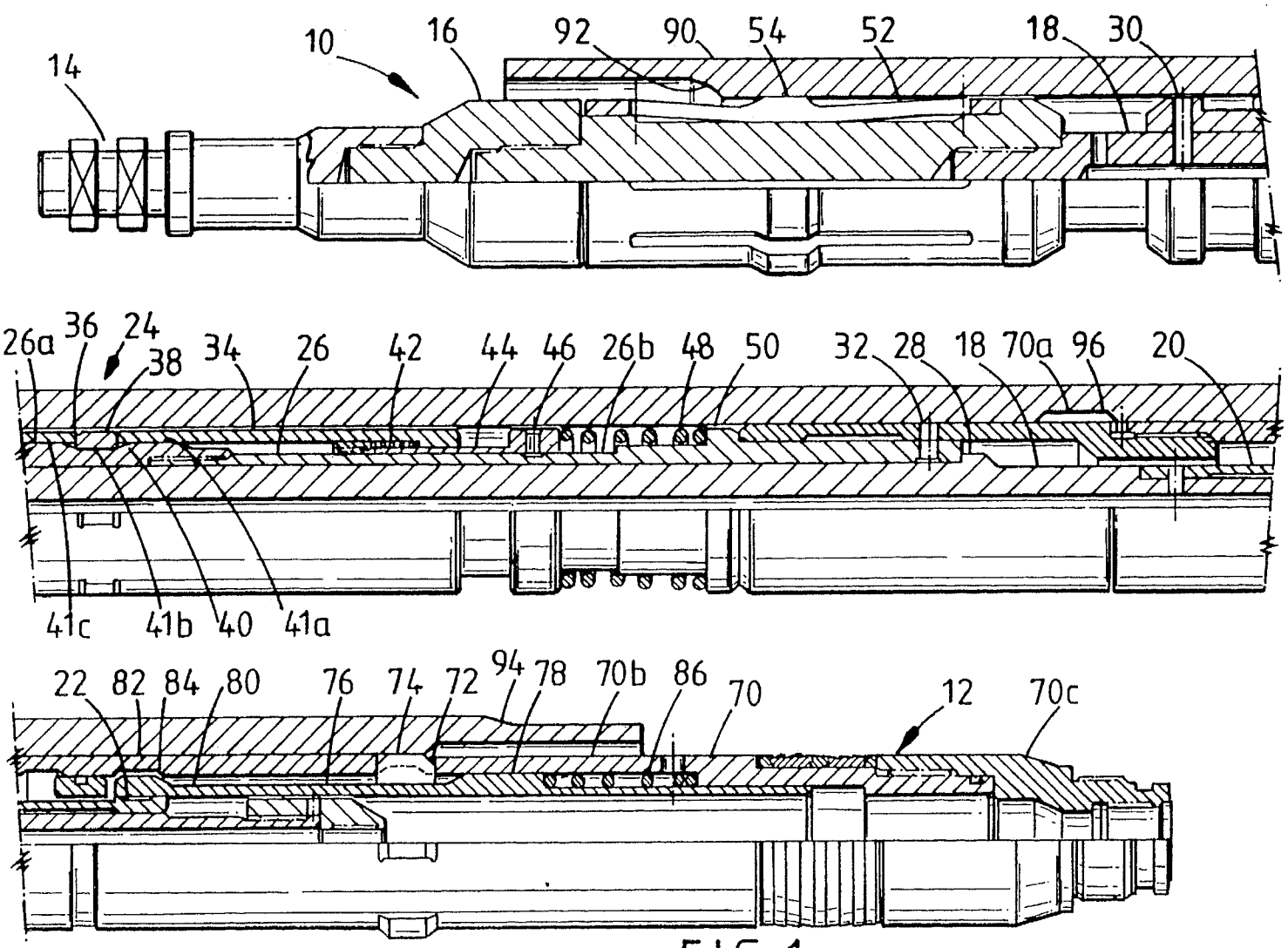
FIG. 1 is a half sectional view of a running tool in accordance with a preferred embodiment of the present invention carrying a lock mandrel and shown running through a nipple.

Reference is first made to FIG. 1 of the drawings which illustrates a running tool 10 in accordance with a preferred embodiment of the present invention. A lock mandrel 12, somewhat similar to that disclosed in U.S. Pat. No. 4,883,121, is mounted on the lower end of the tool 10.

The upper end of the running tool 10 is provided with a conventional connection 14 to permit the tool 10 to be mounted on the lower end of a tool string, to allow the tools 10, 12 to be lowered into a bore. Provided below the connection 14 is a solid generally cylindrical member 16 from which a rod 18 depends. Mounted towards the bottom end of the rod 18 is a set of collets 20 having enlarged heads 22 at the lower end thereof. Mounted on the rod, upwardly of the collets 20, is a first holding means in the form of a key arrangement 24. The arrangement 24 includes a sleeve 26 formed of two parts 26*a*, 26*b* threaded together, the sleeve 26 being supported at its lower end by a shoulder 28 formed on the rod 18. In addition, the upper end of the sleeve 26 is attached to the rod 18 by releaseable connecting means in the form of shear pins 30, while the lower end of the sleeve 26 is attached to the upper end of the lock mandrel 12, also by releaseable connecting means in the form of shear pins 32. A further sleeve 34 is mounted on the exterior of the sleeve 26 and is provided with radially spaced apertures 36 for receiving keys 38. The sleeve 34 is axially movable relative to the inner sleeve 26 and the radial extension of the keys 38 is determined by their position on the profiled outer surface 40 of a mandrel defined by the upper sleeve portion 26*a*. A spring 42 acts between a collar 44 mounted on the inner sleeve 26 by releaseable connecting means in the form of a shear pin 46 and the lower end of the outer sleeve 34, to bias the sleeve 34 to a position in which the keys 38 are radially extended and positioned over a lower support surface 41*a*. In FIG. 1 the sleeve 34 is shown pushed upwardly, against the spring 42, such that the keys 38 are located in a recess 41*b* in the surface 40. A further, heavier spring 48 is provided between the lower end of the collar 34 and a shoulder 50 formed on the inner sleeve 26, though in the configuration illustrated in FIG. 1 the spring 48 is constrained by releaseable connecting means in the form of the pinned collar 44.

While the upper portion of the sleeve 26 is pinned to the rod 18, the upper end of the sleeve 26 and the lower end of the member 16 are spaced apart. Biassing means, in the form of a number of collet fingers 52, are provided on the member 16 and include keying portions 54 which are biased to extend outwardly, beyond the outer diameter of the tool 10. As illustrated in FIG. 1, the fingers 52 are being held in an inwardly deflected position by the contact between the keying portions 54 and the bore casing.

Figure 2:
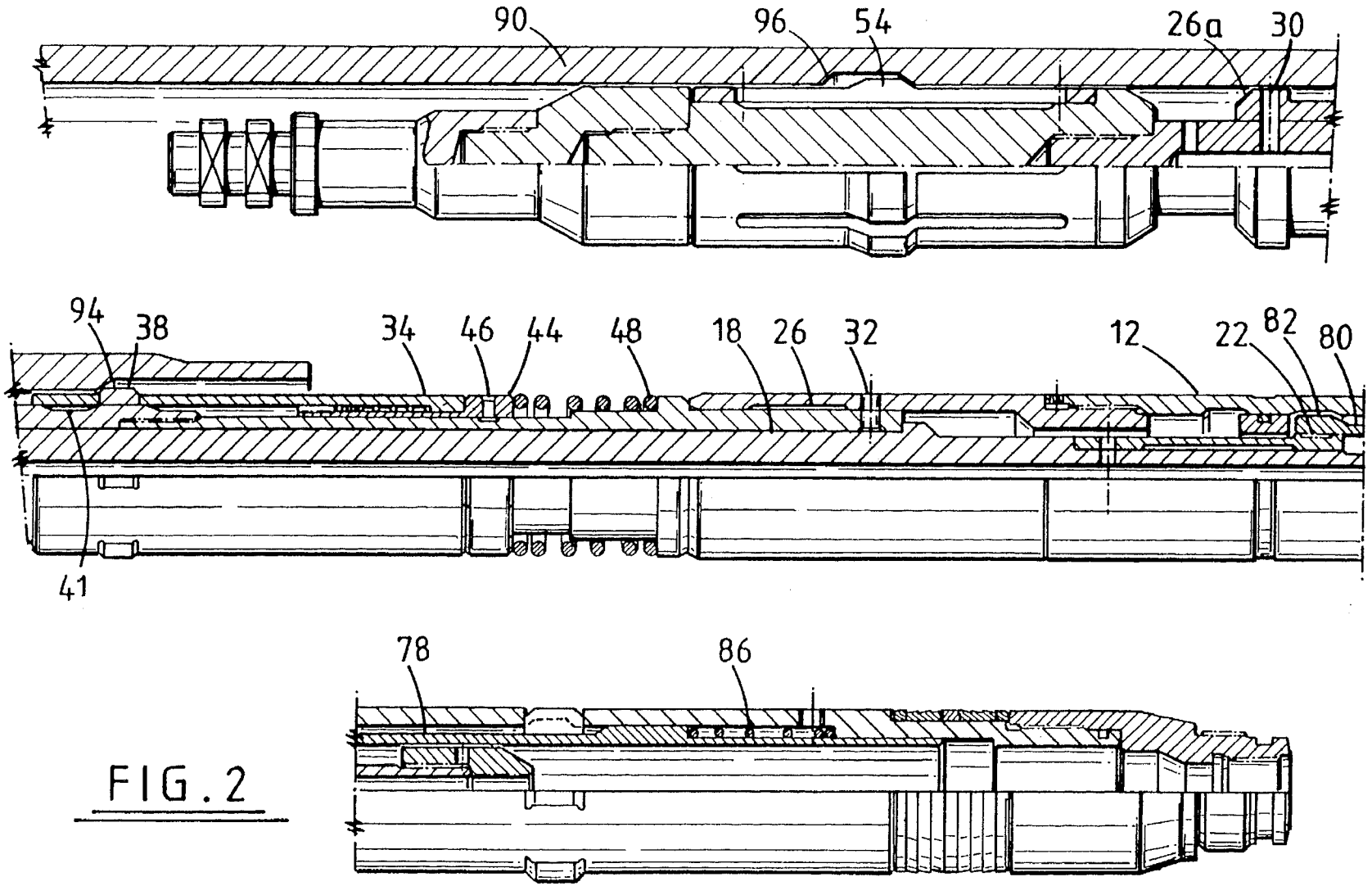
FIG. 2 is a half sectional view corresponding to FIG. 1, but showing the tools in a position relative to the nipple for re-configuring first holding means of the running tool.

The lock mandrel 12, mounted to the lower end of the running tool 12, comprises a tubular body 70 formed of three sections 70*a*, 70*b*, 70*c* which are threaded together. As mentioned above, the upper section 70*a* is attached to the sleeve 26 by means of a shear pin 32. The central portion 70*b* defines a number of radially spaced apertures 72 each of which accommodates a key 74. The radial extension of the keys 74 is controlled by the outer surface 76 of an internal sleeve 78. The upper end of the sleeve 78 is provided with collet fingers 80 having enlarged heads 82 which, in the cocked position, as shown in FIGS. 1 and 2, are held in recessed profiles 84 provided on the interior of the body 70 by means of the collet heads 22 on the running tool 10. A spring 86 acts between the sleeve 78 and a shoulder on the body 70 but, as mentioned above, in the cocked position the location of the collet heads 82 in the profiles 84 prevents extension of the spring 86.

The Figures also illustrate a small section of bore in the form of a nipple 90 defining upper and lower shoulders 92, 94 and an annular recess or nipple profile 96.

On running the tools 10, 12 into a bore provided with a number of nipples 90, the outer diameter of the tools 10, 12 is generally uniform, other than the keys 38 and the keying portions 54 which are arranged to define an outside diameter less than the internal diameter of the bore between the nipples 90, but greater than the internal diameter of the bore at the nipples 90. Thus, as the tools 10, 12 are run through a bore and into a nipple 90, the lock mandrel 12 will pass through the nipple as will the lower end of the running tool 10 until the keys 38 come into contact with the upper shoulder 92. On coming into contact with the shoulder 92 the keys 38, and the outer sleeve 34, are pushed upwardly relative to the rest of the tool 10 until the keys 38 move from the support surface 41*a* inwardly into the recess 41*b* in the surface 40, as shown in FIG. 1, such that the keys 38 may pass the shoulder 92 and travel through the nipple 90. On further downward movement through the bore the keying portions 54 come into contact with the upper shoulder 92. This contact simply deflects the fingers inwardly, to the configuration as shown in FIG. 1, allowing the tool 10 to pass through the nipple 90. The contacts between the keys and the keying portions 38, 54 with the upper shoulder 92 will be clearly detectable at the surface, such that the string operator will realize that the tools 10, 12 have encountered a nipple 90.

A bore may be provided with a number of such nipples and the tools 10, 12 may be passed through a number of these nipples until reaching the nipple at the location where it is desired to set the lock mandrel 12.

On reaching the selected nipple 90, the tools 10, 12 are lowered until the keying portions 54 snap into the profile 96, as shown in FIG. 2. In this position, the keys 38 are located just below the lower shoulder 94.

A jar (not shown) is provided on the tool string above the running tool 10 such that the tool 10 may be jarred to bring the upper faces of the keys 38 into contact with the lower shoulder 94, with the keying portions 54 acting as a stop for the return stroke. The jarring continues until the pins 46 shear. This permits the strong spring 48 to expand and push the collar 44 and outer sleeve 34 upwardly over the upper portion of the sleeve 26*a*.

Figure 3:
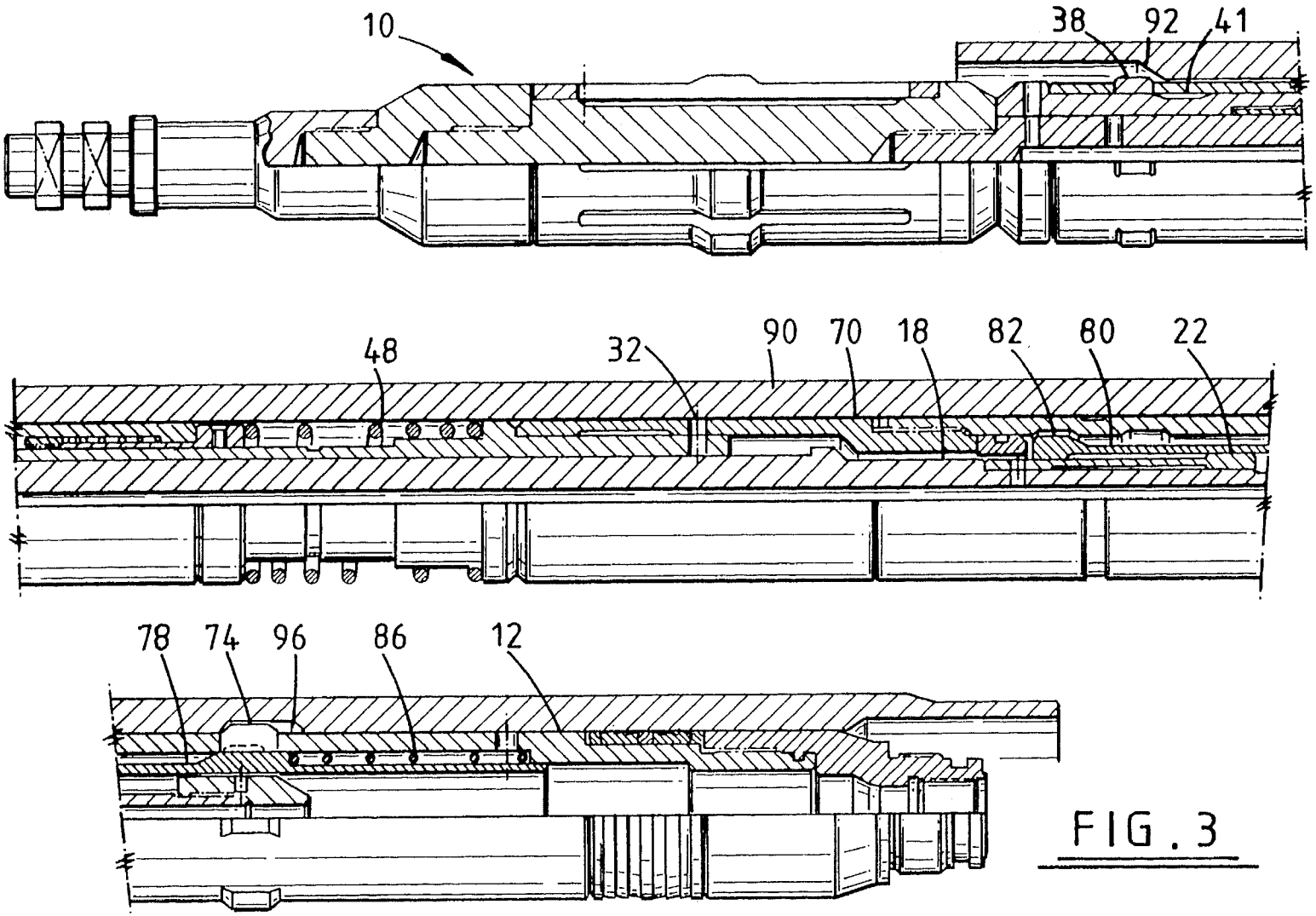
FIG. 3 is a half sectional view corresponding to FIG. 1 and showing the running tool in a position after setting the lock mandrel and ready to retrieve the running tool to surface.

The strong spring 48 pushes the keys 38 beyond the recess 41*b* and locates the keys over an upper support surface 41*c*, however when the string is pulled upwardly the keys 38 and the sleeve 34 are pushed downwardly by the shoulder 94 such that the keys 38 move into the recess 41*b*, allowing the tool 10 to be lifted up through the nipple 90. However, once pulled through the nipple 90, the keys 35 and the sleeve 34 are pushed upwardly once more by the action of the strong spring 48 and the keys 38 remain in the radially extended configuration when brought back down into contact with the upper shoulder 92, as shown in FIG. 3 of the drawings. In this configuration the keys 38 act as a stop for the tool 10 and allow manipulation of the running tool to set the lock mandrel 12, as will be described.

With the tool 10 in this position, jarring downwardly on the string shears the pin 30 allowing the rod 18 to move downwardly relative to the sleeve 26. Thus, the rod 18 also moves downwardly relative to the lock mandrel 12 such that the collet heads 22 on the rod 18 move from behind the collet heads 82 on the internal sleeve 78 of the lock mandrel, allowing the spring 86 to push the collet fingers 80 upwardly to radially extend the keys 74 into the nipple profile 96. The lock mandrel 12 is thus set in the nipple 90.

The string is then jarred upwardly to shear the pin 32 and allow separation of the tools 10, 12.

As the running tool 10 is pulled up through the bore, if any nipples 90 are encountered the keying portions 54 may be deflected inwardly, as when running in, and the keys 38 may be pushed downwardly by contact with the lower shoulders of the nipples 94 such that the keys move into the recess 41*b*, allowing the tools 10, 12 to pass through the nipples.

Thus, the lock mandrel 12 is left in the nipple 90 with only the keys 74 holding the mandrel in place, simplifying removal of the lock mandrel from the bore when desired.

It will be apparent to those of skill in the art that the above-described operation is relatively straightforward to carry out and is achievable with minimal string manipulation. Further, it is apparent that the running tool provides a means for setting a second tool at a selected nipple in a bore without requiring the provisions of no-gos in the bore casing.

It will also be apparent to those of skill in the art that the above described embodiment is merely exemplary of the present invention and that various modifications and improvements may be made thereto without departing from the scope of the present invention, for example: the keys 38 may be replaced with other radially extending arrangements, such as collet fingers.

I claim:

1. A downhole running system for mounting on a string and for use in setting a downhole tool in a bore, the system including a running tool comprising:

means for holding the tool at a desired location in the bore and being selectively configurable, in a first configuration, to permit running the tool in through a series of restrictions in the bore and, in a second configuration, to prevent passage of the tool through a selected one of said restrictions and to engage the wall of the bore to permit manipulation of the tool against a fixed point in the bore;

means for releasably mounting the downhole tool on the running tool; and means for setting the downhole tool;

the downhole tool including self-setting means for storing a setting force which, when said self-setting means is released by actuation of the setting means on the running tool, is sufficient to set the downhole tool in the bore.

2. The system of claim 1, wherein in the first configuration, the holding means is biased to assume the first configuration in which said holding means will engage said restrictions in the bore, but is movable to permit downwards passage of the running tool through said restrictions on engagement with said restrictions.

3. The system of claim 2, wherein the holding means is moveable from the first configuration to the second configuration in which said holding means is biased to engage said restrictions but is movable to permit upwards passage of the running tool through said restrictions on engagement with said restrictions.

4. The system of claim 3, wherein the holding means is moveable from said first configuration to said second configuration by axial movement of the string.

5. The system of claim 4, further including a jar and wherein the holding means is moveable from said first configuration to said second configuration by jarring the running tool.

6. The system of claim 5, wherein the holding means includes radially extendable key members mounted on and moveable relative to a profiled mandrel, the mandrel defining a recess between upper and lower support surfaces, in the first configuration the key members being biased to a radially extended position over the lower support surface but being moveable to a retracted position over the recess to permit running the tool in through said restrictions, and in the second configuration the key members being biased to a radially extended position over the upper support surface but being moveable to said retracted position over the recess to permit upwards passage through said restrictions.

7. The system of claim 5, wherein the running tool further comprises second holding means for releasably engaging said restrictions in the bore.

8. The system of claim 7, wherein the second holding means is located above the first holding means such that the second holding means may retain the running tool in the bore on the return stroke of the jar utilized to move the first holding means between the first and second configurations.

9. The system of claim 7, wherein the second holding means is in the form of collet fingers.

10. The system of claim 1, wherein the actuation of the setting means on the running tool by axial movement of the string permits relative movement of parts of the downhole tool to extend engagement means to engage with recesses in the bore wall.

11. A method of setting a downhole tool in a bore, the method comprising the steps:

a) mounting the downhole tool on a running tool provided with means for holding the running tool at a desired location in the bore;

b) running the tools into a bore on a string with the holding means in a first configuration to permit the running tool to pass through restrictions in the bore;

c) arranging the holding means in a second configuration to engage a wall of the bore and to prevent passage of the running tool through a selected one of said restrictions;

d) manipulating the string, against said holding means, to release biasing means for setting the downhole tool in the bore;

e) manipulating the string to release the running tool from the downhole tool; and f) pulling the running tool out of the bore.

12. The method of claim 11, wherein in step b), the holding means is biased to assume the first configuration in which the holding means will engage restrictions in the bore, but is moveable to permit downwards passage of the running tool through said restrictions on engagement with said restrictions.

13. The method of claim 12, wherein in step c), the holding means is moved from the first configuration to the second configuration in which the holding means is biased to engage said restrictions in the bore but is moveable to permit upwards passage of the running tool through said restrictions on engagement with said restrictions.

14. The method of claim 13 including the step of manipulating the string to move the holding means from said first configuration to said second configuration.

15. The method of claim 14, including the step of jarring the running tool to move the holding means from the first configuration to the second configuration.

16. The method of claim 15, comprising the further steps of:

providing the running tool with second holding means above the first holding means; and releasably engaging restrictions in the bore with the second holding means on a return stroke during said jarring of the holding means between the first and second configurations.

* * * * *

UNITED STATES PATENT AND TRADEMARK OFFICE

CERTIFICATE OF CORRECTION

PATENT NO. : 5,538,082

DATED : July 23, 1996

INVENTOR(S) : Klaas Johannes Zwart

It is certified that error appears in the above-identified patent and that said Letters Patent is hereby corrected as shown below:

Title page, item [76], in the Inventor's address, "Inchagarth" should be -- Inchgarth --.

Column 5, line 11, "35" should be -- 38 --; column 8, line 12, after "of" insert -- the running tool when moving --.

Signed and Sealed this

Third Day of December, 1996

Bruce Lehman

*Attest:*

BRUCE LEHMAN

*Attesting Officer*

*Commissioner of Patents and Trademarks*